US008915759B2

(12) United States Patent
Miyamoto

(10) Patent No.: US 8,915,759 B2
(45) Date of Patent: Dec. 23, 2014

(54) TERMINAL CONNECTOR WITH ELECTRIC WIRE AND METHOD OF MANUFACTURING THE SAME

(75) Inventor: Kenji Miyamoto, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 42 days.

(21) Appl. No.: 13/807,881

(22) PCT Filed: Jul. 7, 2011

(86) PCT No.: PCT/JP2011/065558

§ 371 (c)(1),
(2), (4) Date: Dec. 31, 2012

(87) PCT Pub. No.: WO2012/011394

PCT Pub. Date: Jan. 26, 2012

(65) Prior Publication Data

US 2013/0109251 A1 May 2, 2013

(30) Foreign Application Priority Data

Jul. 21, 2010 (JP) ..... 2010-163981

(51) Int. Cl.

| | |
|---|---|
| ***H01R 4/48*** | (2006.01) |
| ***H01R 13/11*** | (2006.01) |
| ***H01R 4/02*** | (2006.01) |
| ***H01R 43/02*** | (2006.01) |
| *H01R 4/18* | (2006.01) |

(52) U.S. Cl.

CPC ..... *H01R 13/113* (2013.01); *H01R 4/02* (2013.01); *H01R 43/02* (2013.01); *H01R 43/0214* (2013.01); *H01R 4/183* (2013.01)

USPC ..... 439/862

(58) Field of Classification Search

USPC ..... 439/862, 752, 856–857, 395, 744, 268, 439/842, 839, 745

See application file for complete search history.

(56) References Cited

U.S. PATENT DOCUMENTS 4,458,971 A * 7/1984 D'Urso et al. ..... 439/268
4,932,891 A * 6/1990 Spanke et al. ..... 439/395

(Continued)

FOREIGN PATENT DOCUMENTS

JP A-2-223164 9/1990
JP A-09-017482 1/1997

(Continued)

OTHER PUBLICATIONS

Aug. 16, 2011 Written Opinion of the International Searching Authority issued in International Patent Application No. PCT/JP2011/065558.

(Continued)

*Primary Examiner* — Jean F Duverne
(74) *Attorney, Agent, or Firm* — Oliff PLC

(57) ABSTRACT

A terminal connector with an electric wire includes a bottom portion, a wall, a plurality of connection pieces, and an auxiliary wall. An end portion of the electric wire is placed on and connected to the bottom portion. The electric wire includes a core wire exposed at the end portion. The wall is provided continuously from the bottom portion and integrally rises from one side of the bottom portion extending to another side. One of the connection pieces extends from one end of the bottom portion and another one of the connection pieces extends from one end of the wall and the connection pieces are contacted and connected to an opposing terminal connector. The auxiliary wall is provided continuously from another end of the wall that is opposite from the one end from which the connection piece extends. The auxiliary wall extends downwardly to the bottom portion.

6 Claims, 9 Drawing Sheets

(56) References Cited

U.S. PATENT DOCUMENTS

| | | | | |
|---|---|---|---|---|
| 4,932,906 | A | 6/1990 | Kaley et al. | |
| 4,950,186 | A | 8/1990 | Kaley et al. | |
| 5,749,755 | A * | 5/1998 | Genta et al. | 439/856 |
| 6,068,505 | A | 5/2000 | Sai | |
| 6,203,385 | B1 * | 3/2001 | Sato et al. | 439/852 |
| 6,227,882 | B1 * | 5/2001 | Ortega et al. | 439/101 |
| 6,386,928 | B2 * | 5/2002 | Kitamura | 439/852 |
| 6,402,571 | B1 * | 6/2002 | Muller et al. | 439/745 |
| 7,094,114 | B2 | 8/2006 | Kurimoto | |
| 7,291,046 | B2 * | 11/2007 | Russelburg | 439/857 |
| 7,458,863 | B2 * | 12/2008 | Shimizu | 439/842 |
| 2005/0032440 | A1 | 2/2005 | Kurimoto | |

FOREIGN PATENT DOCUMENTS

| | | |
|---|---|---|
| JP | A-09-115560 | 5/1997 |
| JP | A-11-195445 | 7/1999 |
| JP | A-2000-100499 | 4/2000 |
| JP | A-2005-56792 | 3/2005 |

OTHER PUBLICATIONS

Aug. 16, 2011 International Search Report issued in International Application No. PCT/JP2011/065558.

Japanese Office Action issued in Japanese Application No. 2010-163981 on Mar. 13, 2014 (with translation).

Notification of Refusal dated Sep. 2, 2014 from Japanese Patent Application No. 2010-163981 (with English-language translation).

* cited by examiner

TERMINAL CONNECTOR WITH ELECTRIC WIRE AND METHOD OF MANUFACTURING THE SAME

TECHNICAL FIELD

The present invention relates to a terminal connector with an electric wire and a method of manufacturing the same.

BACKGROUND ART

A terminal connector with an electric wire disclosed in Patent Document 1 is known as an example of such a kind. The terminal connector is configured with a metal plate and includes a barrel piece and a terminal connection portion (see FIG. 1 of Patent Document 1). The barrel piece is fitted with pressure to a core wire that is exposed at an end portion of the wire. The terminal connection portion is connected to a terminal that is to be connected to.

In the terminal connector disclosed in Patent Document 1, the barrel piece is provided by extending a wire connection portion in a width direction. An end portion of the wire is placed on and connected to the wire connection portion. The terminal connection portion of the terminal connector includes a bottom plate and an elastic piece. The bottom plate is continuously provided from the wire connection portion. The elastic piece is provided to face the bottom plate. The terminal that is to be connected is sandwiched and held between the bottom plate and the elastic piece and the terminal is electrically connected to the terminal connector.

[Patent Document 1] Japanese Unexamined Patent Publication No. 2000-100499

In the above terminal connector, the elastic piece of the terminal connection portion is continuously provided from side walls rising from the bottom plate, and the elastic piece is provided to be apart from the end portion of the electric wire.

With this configuration, if current flows through the wire that is connected to the terminal connector, current flowing through the wire connection portion and the barrel piece that are connected to the wire is concentrated on the bottom plate. This increases resistance in the bottom plate and this may cause heat generation in case of flowing of great current.

The present invention has been completed in view of the circumstances described above. Therefore, there is a need in the art to provide a terminal connector with an electric wire in which concentration of current flowing is less likely to be caused and heat generation is less likely to occur in case of flowing of great current.

SUMMARY

To solve the above problems, according to the present technology, a terminal connector with an electric wire includes a bottom portion which an end portion of the electric wire is placed on and connected to, the electric wire including a core wire that is exposed at the end portion, a wall provided continuously from the bottom portion and integrally rising from one side of the bottom portion and extending to another side of the bottom portion that is opposite to the one side, a plurality of connection pieces one of which extends from one end of the bottom portion and another one of which extends from one end of the wall, and the connection pieces being contacted and connected to a terminal of an opposing terminal connector, and an auxiliary wall provided continuously from another end of the wall that is opposite from the one end of the wall from which the connection piece extends, the auxiliary wall extending downwardly toward the bottom portion. The auxiliary wall is bonded to the bottom portion with the end portion of the electric wire.

According to the terminal connector with an electric wire of the present technology, the auxiliary wall is provided on the wall that continuously extends from the one side to the other side of the bottom portion of the terminal connector. The auxiliary wall extends downwardly toward the bottom portion. The auxiliary wall is bonded to the bottom portion with the end portion of the electric wire. Therefore, current flowing through the electric wire flows through the bottom portion and also through the auxiliary wall. The current flowing through the bottom portion and the auxiliary wall flows to the connection pieces one of which extends from the one end of the bottom portion and another one of which extends from the one end of the auxiliary wall. Accordingly, the terminal connector is electrically connected to a terminal of an opposing terminal connector.

According to the present technology, the current flowing through the electric wire flows to the bottom portion and the auxiliary wall. Therefore, concentration of current flowing is less likely to be caused and heat generation is less likely to be caused in case of flowing of great current.

As a result, the present technology provides a terminal connector with an electric wire in which concentration of current flowing is less likely to be caused and heat generation is less likely to be caused in case of flowing of great current.

According to the present technology, the end portion of the electric wire is bonded to the bottom portion and also bonded to the auxiliary wall extending downwardly toward the bottom portion. Therefore, the electric wire is positioned precisely.

According to another aspect of the present technology, a method of manufacturing a terminal connector with an electric wire includes placing an end portion of the electric wire on a bottom portion of the terminal connector, the electric wire having a core wire that is exposed at the end portion. The terminal connector includes a bottom portion which the end portion of the electric wire is placed on and connected to, a wall provided continuously from the bottom portion and integrally rising from one side of the bottom portion and extending to another side of the bottom portion that is opposite to the one side, a plurality of connection pieces one of which extends from one end of the bottom portion and another one of which extends from one end of the wall, and the connection pieces being contacted and connected to a terminal of an opposing terminal connector, and an auxiliary wall provided continuously from another end of the wall that is opposite from the one end of the wall from which the connection piece extends, the auxiliary wall extending downwardly to the bottom portion. The method further includes bonding the auxiliary wall to the bottom portion with the end portion of the electric wire with brazing.

The method of manufacturing a terminal connector with an electric wire of the present technology provides a terminal connector with an electric wire that is obtained by bonding the auxiliary wall to the bottom portion with the end portion of the electric wire.

With the terminal connector with an electric wire, the current flowing through the electric wire flows to the bottom portion and the auxiliary wall. Therefore, concentration of current flowing is less likely to be caused and heat generation is less likely to be caused in case of flowing of great current. As a result, the method of the present technology provides a terminal connector with an electric wire in which concentration of current flowing is less likely to be caused and heat generation is less likely to be caused in case of flowing of great current. According to the present technology, the end portion of the electric wire is bonded to the bottom portion and also bonded to the auxiliary wall extending downwardly toward the bottom portion. Therefore, the electric wire is positioned precisely.

According to the method of manufacturing a terminal connector with an electric wire, the auxiliary wall is bonded to the bottom portion with the end portion of the electric wire by brazing. Therefore, the auxiliary wall, the end portion of the electric wire, and the bottom portion are bonded to each other in one process step.

According to a terminal connector with an electric wire of the present invention, concentration of current flowing is less likely to be caused and heat generation is less likely to occur in case of flowing of great current.

EXPLANATION OF SYMBOLS

10: TERMINAL CONNECTOR WITH ELECTRIC WIRE
11: ELECTRIC WIRE
11A: END PORTION
20: TERMINAL CONNECTOR
21: MAIN BODY PORTION
22: BOTTOM PORTION
22A: ONE SIDE
22B: ANOTHER SIDE
22C: FRONT END OF BOTTOM PORTION (ONE END OF BOTTOM PORTION)
23: WALL
24: SIDE WALL (WALL)
25: CEILING WALL (WALL)
25A: FRONT END OF CEILING WALL (ONE END OF WALL)
25B: REAR END OF CEILING WALL (ANOTHER END OF WALL OPPOSITE TO THE ONE END)
26: AUXILIARY WALL
27A, 27B: CONNECTION PIECE
30: BRAZING FILLER METAL
40: OPPOSING TERMINAL CONNECTOR (OPPOSING TERMINAL)
41: TAB

BEST MODES FOR CARRYING OUT THE INVENTION

First Embodiment

A first embodiment will be explained with reference to FIGS. 1 to 8. In FIGS. 1, 2 and 6 to 8, a left upper side corresponds to a front side and a right lower side corresponds to a rear side. In FIGS. 4 and 5, a left side corresponds to a front side and a right side corresponds to a rear side.

A terminal connector with an electric wire 10 of the present embodiment is used for a connector used in a circuit through which great current flows. Examples of such a connector is included in a battery, an inverter, a motor that configure a running power source in an electric vehicle (not illustrated).

Figure 1:
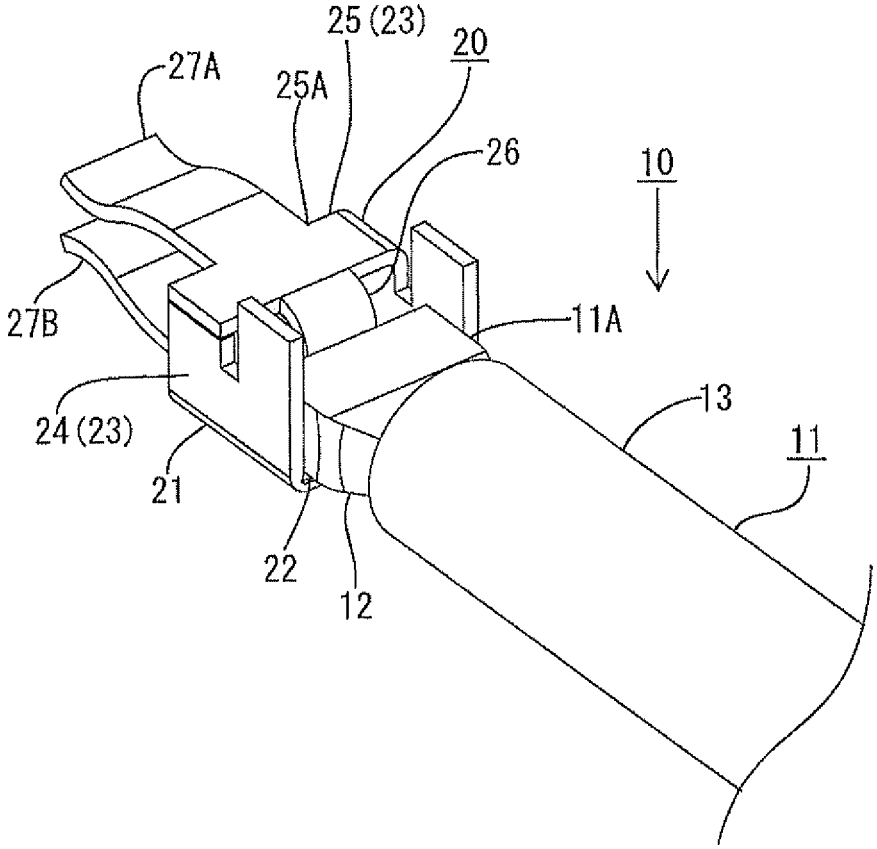
FIG. 1 is a perspective view illustrating a terminal connector with an electric wire according to a first embodiment.

As illustrated in FIG. 1, the terminal connector with an electric wire 10 of the present embodiment includes a terminal connector 20 and an electric wire 11 that is connected to a bottom portion 22 of the terminal connector 20.

The electric wire 11 includes a core wire 12 and wire insulation 13. The core wire 12 is configured with a plurality of metal strands and the wire insulation 13 is made of synthetic resin and covers an outer periphery of the core wire 12. Any metal suitable for intended application such as aluminum, aluminum alloy, copper, copper alloy or other metals can be used for the core wire 12. In the present embodiment, aluminum or aluminum alloy is used for the core wire 12. The wire insulation 13 is removed at an end portion 11A of the electric wire 11 so as to expose the core wire 12 therefrom. The exposed core wire 12 is formed in a flat shape.

Figure 2:
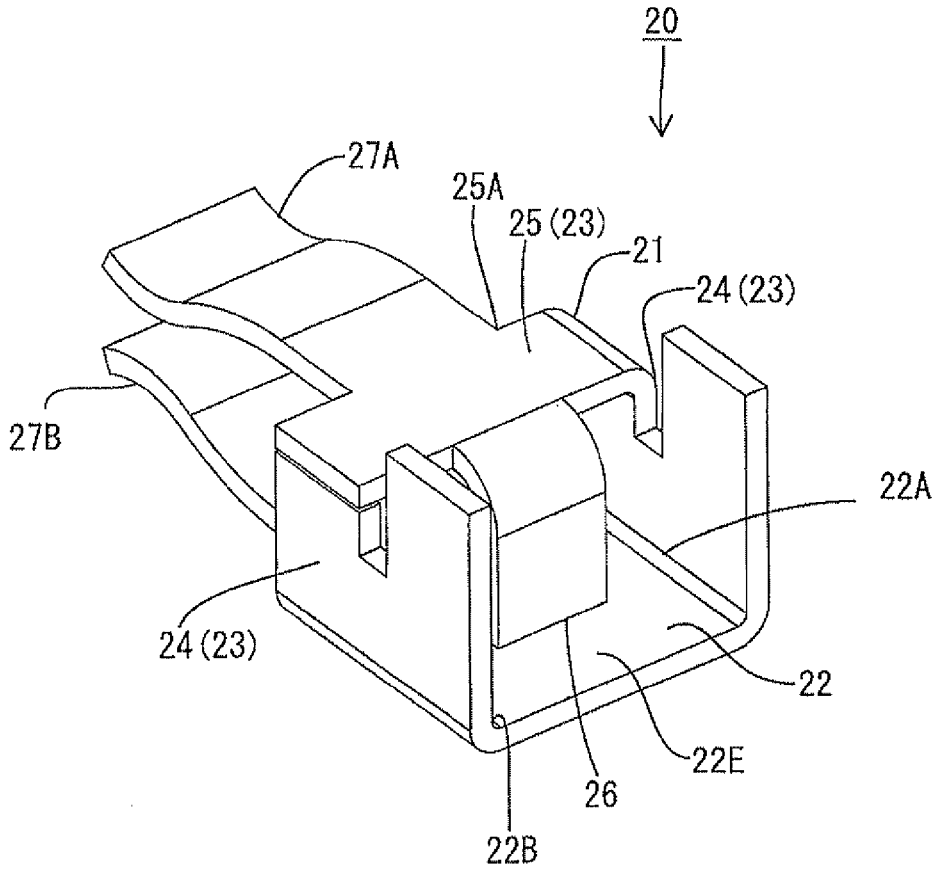
FIG. 2 is a perspective view illustrating the terminal connector before an electric wire is connected thereto.

The terminal connector 20 to which the electric wire 11 is connected is formed from a metal plate made of copper or copper alloy. As illustrated in FIG. 2, the terminal connector 20 includes a main body portion 21 and two connection pieces 27A, 27B (a plurality of connection pieces 27A, 27B). The main body portion 21 is formed in a box shape having an opening on a front side. The connection pieces 27A, 27B extend frontward from a front end of the main body portion 21.

The main body portion 21 includes a bottom portion 22 and a wall 23. The electric wire 11 is placed on the bottom portion 22. The wall 23 rises from one side portion 22A of the bottom portion 22 and extends continuously to another side portion 22B. The wall 23 connects two side walls 24, 24 each of which rises from the side portions 22A, 2213 (one side portion 22A and anther side portion 22B) of the bottom portion 22 and the wall 23 is configured with a ceiling wall 25 that is provided to face the bottom portion 22.

The ceiling wall 25 is provided on only a front side of the main body portion 21. A wall 26 (an auxiliary wall 26) is continuously formed from a rear end 25B of the ceiling wall 25 (an end portion 25B opposite to one end portion 25A) and the wall 26 extends from the rear end 253 downwardly toward the bottom portion 22. A connection piece 27A extends frontwardly from a front end portion 25A (the one end portion 25A) of the ceiling wall 25. Another connection piece 27B extends from a front end portion 22C (one end portion 220) of the bottom portion 22 and provided to face the connection piece 27A extending from the ceiling wall 25.

Figure 3:
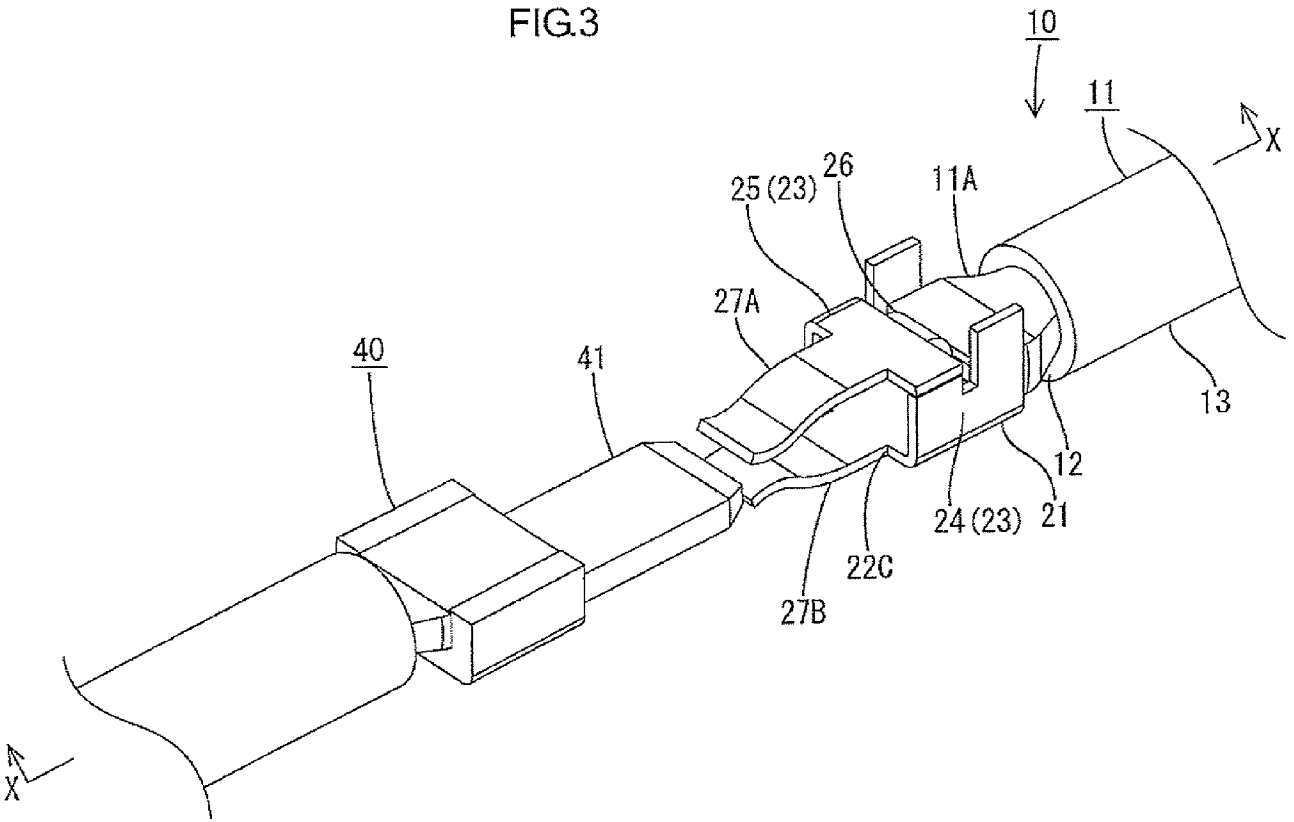
FIG. 3 is a perspective view illustrating the terminal connector before an opposing terminal connector is connected thereto.
Figure 4:
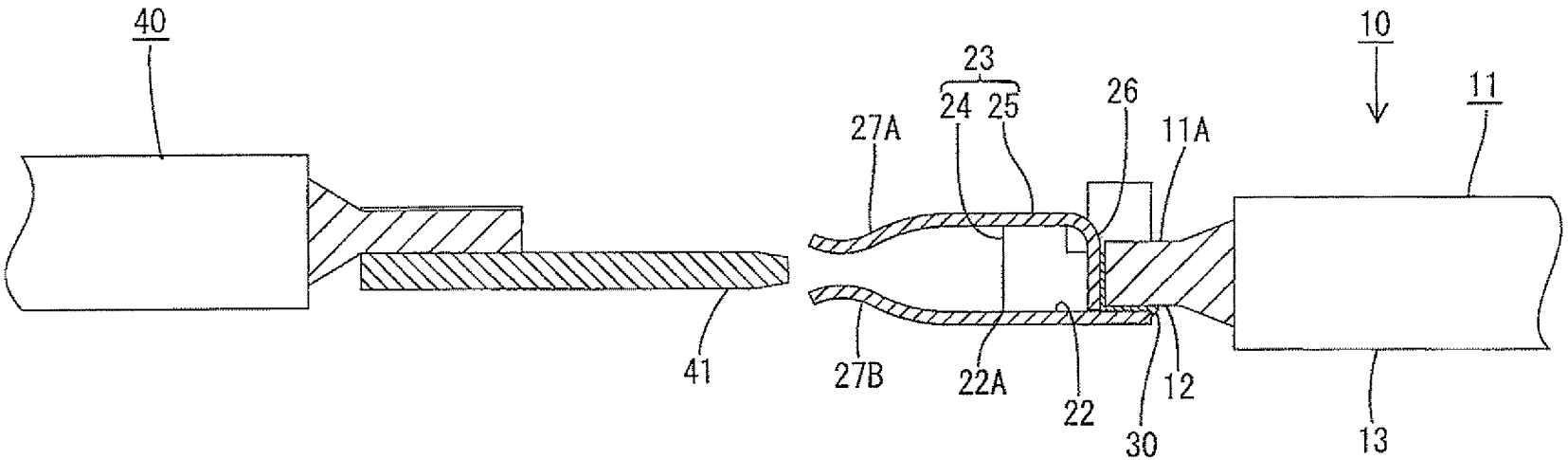
FIG. 4 is a partially cross-sectional view taken along an X-X line in FIG. 3.
Figure 5:
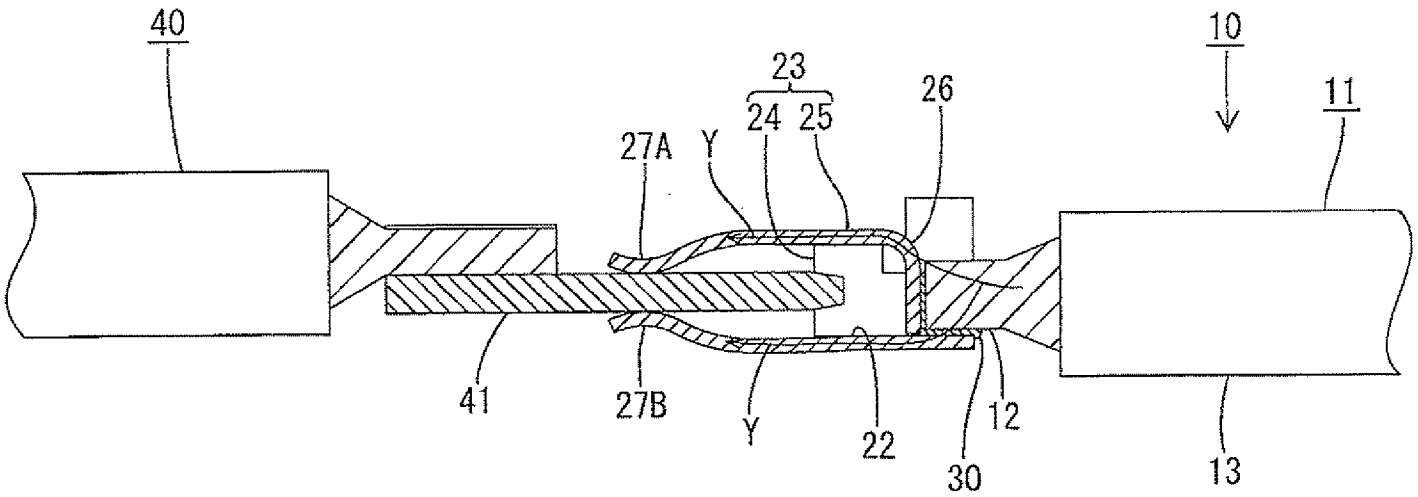
FIG. 5 is a partially cross-sectional view illustrating the terminal connector with an electric wire to which the opposing terminal connector is fitted.

As illustrated in FIGS. 3 to 5, a tab 41 of an opposing terminal connector 40 is placed on the connection pieces 27A and 27B so as to be in contact with each other. In the present embodiment, the two connection pieces 27A and 27B are provided to face with each other. Therefore, the tab 41 of the opposing terminal 40 is sandwiched and held between the connection pieces 27A and 27B and electrically connected to the connection pieces 27A, 27B (refer to FIG. 5).

In the present embodiment, the end portion 11A of the electric wire 11 is placed on an area 223 (a rear area 22E) of the bottom portion 22 that is located on a rear side of the auxiliary wall 26 and is not covered with the ceiling wall 25. Accordingly, the electric wire 11 is connected to the terminal connector 20. The end portion 11A of the electric wire 11 that is placed on the rear area 22E of the bottom portion 22 is bonded to the bottom portion 22 and the auxiliary wall 26 of the terminal connector 20 with brazing (see FIGS. 1, 4 and 5).

The terminal connector with an electric wire 10 of the present embodiment is manufactured by a following method, for example.

Figure 6:
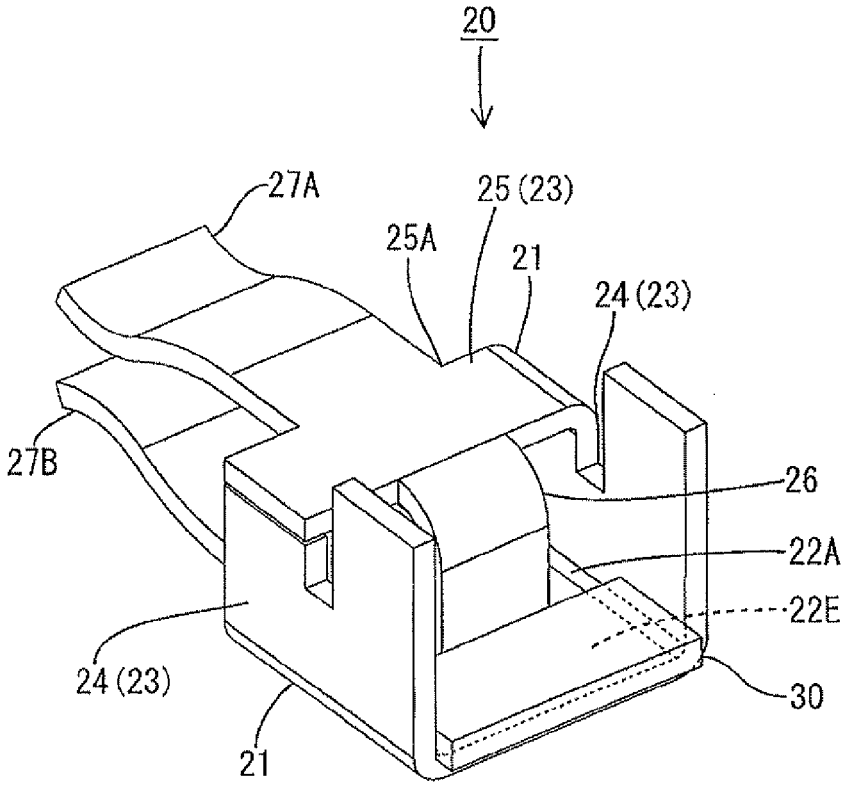
FIG. 6 is a perspective view illustrating the terminal connector having a brazing filler metal that is placed on a bottom portion of the terminal connector of FIG. 2.
Figure 7:
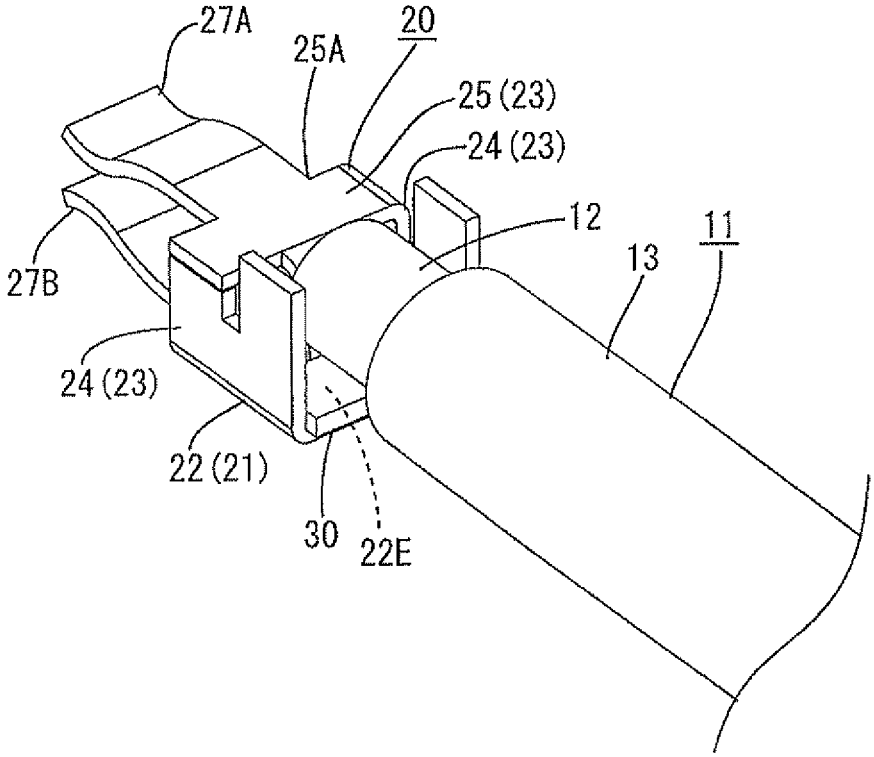
FIG. 7 is a perspective view illustrating the terminal connector having an electric wire that is placed on the bottom portion of the terminal connector of FIG. 6.

As illustrated in FIG. 6, a brazing filler metal 30 formed in a sheet-like shape (for example, brazing filler metal of phosphorus copper containing silver, JIS Z3264, B-CuP5) is placed on the rear area 22E of the bottom portion 22 of the terminal connector 20 illustrated in FIG. 2. Next, the end portion 11A of the electric wire 11 at which the wire insulation 13 is removed and the core wire 12 is exposed is placed on the sheet-like brazing filler metal 30 (see FIG. 7). At this time, the electric wire 11 is placed on the brazing filler metal 30 such that a distal end of the core wire 12 of the electric wire 11 comes in contact with the auxiliary wall 26 or is located close to the auxiliary wall 26.

Figure 8:
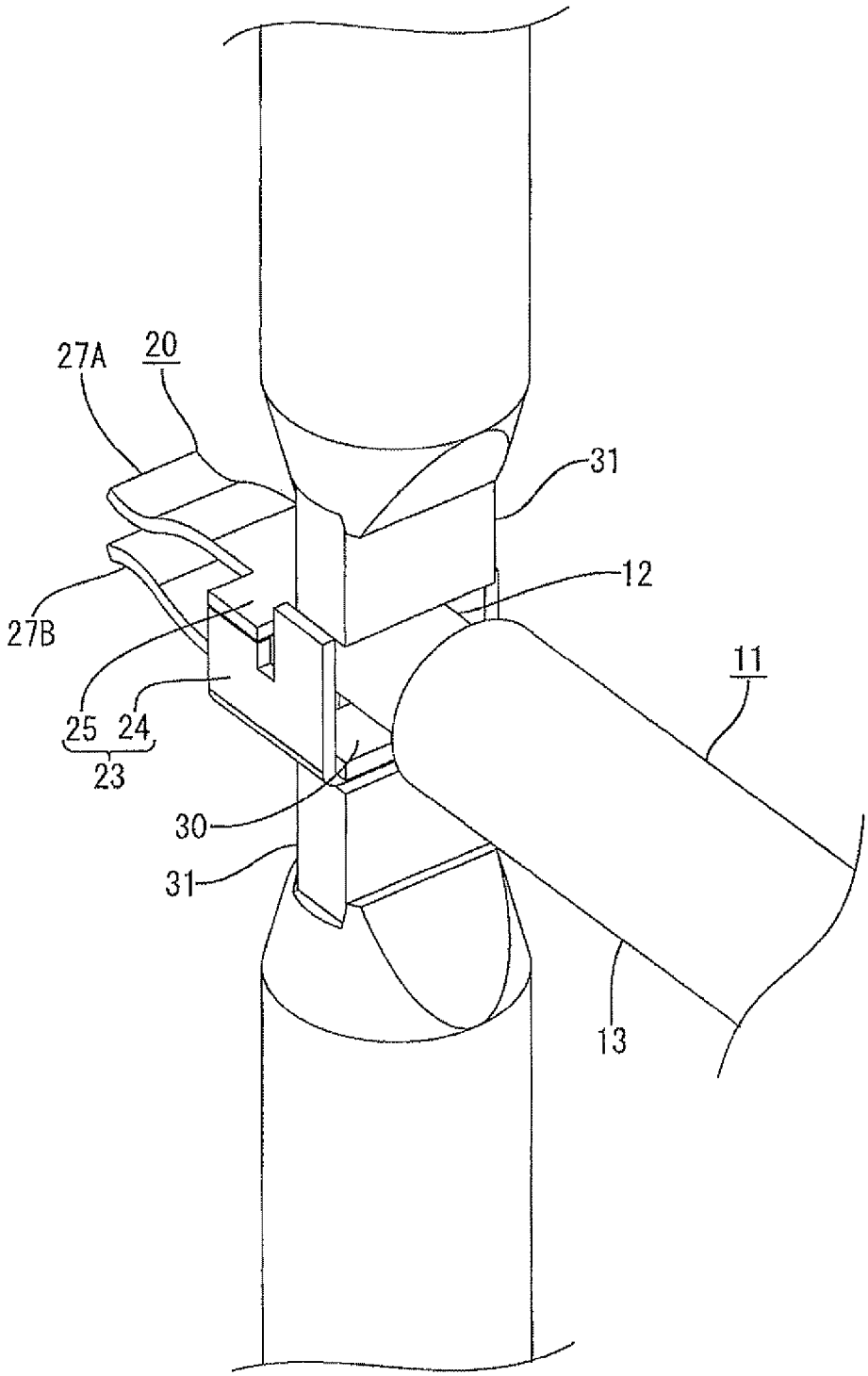
FIG. 8 is a perspective view illustrating the terminal connector in which an end portion of the electric wire is bonded with resistance welding to the bottom portion of the terminal connector of FIG. 7.

As illustrated in FIG. 8, an electrode 31 is placed on a lower side surface of the bottom portion 22 of the terminal connector 20 and another electrode is 31 is placed on an upper side of the core wire 12 of the electric wire 11 and power is supplied thereto. Accordingly, the brazing filler metal 30 is heated with resistance welding. Specifically, current of 8.0 kA is supplied to the electrodes 31 for 500 milliseconds and this current supply is repeated six times at intervals of 20 milliseconds to carry out resistance welding. The brazing filler metal 30 is heated and melted by resistance welding and diffused to bond the core wire 12, the bottom portion 22, and the auxiliary wall 26 each other. The core wire 12 is positioned in a predetermined position with brazing.

In the present embodiment, examples of the brazing filler metal 30 include copper solder, silver solder, aluminum solder, phosphorus copper solder, nickel solder, gold solder, palladium solder, magnesium solder and the like each of which has heat resistance property and corrosion-resistant characteristics. Among the examples, phosphorus copper solder that is excellent in the heat resistance property, strength, and affinity is preferably used as the brazing filler metal 30. Especially, among the phosphorus copper solders, phosphorus copper solder containing silver (the above described phosphorus copper solder containing silver) is preferably used as the brazing filler metal 30.

Advantageous effects of the present embodiment will be explained.

In the terminal connector 10 with an electric wire according to the present embodiment, the auxiliary wall 26 is provided on the ceiling wall 25 that is integrally and continuously formed from the bottom portion 22. The auxiliary wall 26 extends from the ceiling wall 25 downwardly toward the bottom portion 22. The auxiliary wall 26 and the end portion 11A of the electric wire 11 are bonded to the bottom portion 22. With this configuration, current flowing through the electric wire 11 flows through the bottom portion 22 and the auxiliary wall 26. The current flowing through the bottom portion 22 and the auxiliary wall 26 flows to the connection pieces 27A and 275 each of which extends from the front end 22C of the bottom portion 22 and the front end 25A of the ceiling wall 25, respectively. The current flows from the connection pieces 27A and 27B to the opposing terminal connector 40 and the terminal connector 10 is electrically connected to the terminal connector 40 (refer to arrow Y in FIG. 5). In the present embodiment, the current flowing through the electric wire 11 is branched into the bottom portion 22 and the auxiliary wall 26. Accordingly, concentration of current flowing is less likely to be caused and also heat generation is less likely to be caused in case of flowing of great current.

As a result, the present embodiment provides the terminal connector with an electric wire 10 in which concentration of current flowing is less likely to occur and heat generation is less likely to be caused in case of flowing of great current.

According to the present embodiment, the end portion 11A of the electric wire 11 is bonded to the bottom portion 22 and also bonded to the auxiliary wall 26 that extend from the ceiling wall 25 downwardly toward the bottom portion 22. Therefore, the electric wire 11 is positioned precisely.

According to the present embodiment, the auxiliary wall 26 is bonded to the bottom portion 22 with the end portion 11A of the electric wire 11 with brazing. Therefore, the auxiliary wall 26, the end portion 11A of the electric wire 11 and the bottom portion 22 are bonded to each other in one process step.

According to the present embodiment, the auxiliary wall 26, the end portion 11A of the electric wire 11 placed on the bottom portion 22, and the bottom portion 22 are bonded with each other by brazing with resistance welding. This improves precision in bonding.

Other Embodiments

The present invention is not limited to the aspects explained in the above description made with reference to the drawings. The following aspects may be included in the technical scope of the present invention, for example.

(1) In the above embodiments, the auxiliary wall 27 is bonded to the bottom portion 22 with the end portion 11A of the electric wire 11 by brazing with resistance welding. However, it is not limited thereto. For example, the auxiliary wall 27 may be bonded to the bottom portion 22 with the end portion 11A of the electric wire 11 by ultrasonic welding or soldering.

(2) In the above embodiments, the auxiliary wall 27, the end portion 11A of the electric wire 11, and the bottom portion 22 are bonded with each other in one process step. However, after the end portion 11A of the electric wire 11 is bonded to the bottom portion 22, the auxiliary wall 27 may be bonded to the end portion 11A. The bonding process may not be limited as long as the auxiliary wall 27 is bonded to the bottom portion 22 with the end portion 11A of the electric wire 11.

Figure 9:
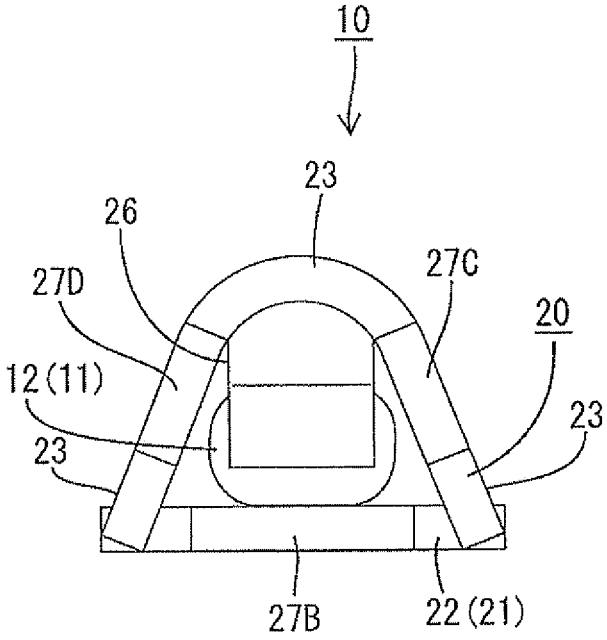
FIG. 9 is a front view illustrating a terminal connector with an electric wire of another embodiment seen from a connection piece side.

(3) In the above embodiments, the terminal connector 20 includes two connection pieces 27A, 27B. However, as illustrated in FIG. 9, the terminal connector 20 may include three connection pieces 27B, 27C, 270 or may include four or more connection pieces. In FIG. 9, the same numbers and symbols are applied to the components same as those in the first embodiment.

(4) In the above embodiments, phosphorus copper solder containing silver is used as the brazing filler metal 30. However, phosphorus copper solder without containing silver, copper solder, silver solder, aluminum solder, nickel solder, gold solder, palladium solder, magnesium solder and the like may be used as the brazing filler metal 30.

(5) In the above embodiments, the brazing filler metal 30 is formed in a sheet-like shape. However, the brazing filler metal 30 may be formed in a paste or powder.

(6) In the above embodiments, a circular cable is used as the electric wire 11 that is connected to the terminal connector. However, a flat cable formed in a flat shape may be used as the electric wire 11.

The invention claimed is:

1. A terminal connector with an electric wire, the terminal connector comprising:

a bottom portion, the electric wire having an end portion of the electric wire placed on and connected to the bottom portion, the electric wire including a core wire that is exposed at the end portion;

a wall extending continuously and integrally from a first end of the bottom portion and having an extended end being connected to a second end of the bottom portion that is opposite to the first end;

a bottom portion connection piece extending continuously from a third end of the bottom portion;

a wall side connection piece extending continuously from one end of the wall, the wall side connection piece and the bottom portion connection piece together configured to be in contact with and connected to a terminal of an opposing connector; and an auxiliary wall extending continuously from another end of the wall that is opposite to the one end of the wall from which the wall side connection piece extends, the auxiliary wall extending downwardly toward the bottom portion, the auxiliary wall and the bottom portion being joined to the end portion of the electric wire.

2. The terminal connector according to claim 1, wherein the end portion of the electric wire is braze bonded to the auxiliary wall and the bottom portion.

3. The terminal connector according to claim 1, wherein the wall includes the side walls and a ceiling wall between the side walls, the wall side connection piece extending from one end of the ceiling wall, and the auxiliary wall extending from another end of the ceiling wall opposite the end from which the wall side connection piece extends.

4. The terminal connector according to claim 1, wherein the auxiliary wall comprises an extended end, the extended end of the auxiliary wall being in contact with the bottom portion.

5. A method of manufacturing a terminal connector with an electric wire, the electric wire having an end portion and a core wire that is exposed at the end portion, the method comprising:

providing a terminal connector, the terminal connector comprising:

a bottom portion;

a wall extending continuously and integrally from a first end of the bottom portion and having an extended end being connected to a second end of the bottom portion that is opposite to the first end;

a bottom portion connection piece extending continuously from a third end of the bottom portion;

a wall side connection piece extending continuously from one end of the wall, the wall side connection piece and the bottom portion connection piece together configured to be in contact with and connected to a terminal of an opposing connector; and an auxiliary wall extending continuously from another end of the wall that is opposite to the one end of the wall from which the wall side connection piece extends, the auxiliary wall extending downwardly toward the bottom portion;

placing the end portion of the electric wire on the bottom portion of the terminal connector such that the end portion is in contact with the bottom portion and the auxiliary wall; and bonding the end portion of the electric wire to the auxiliary wall and the bottom portion with brazing.

6. The method according to claim 5, wherein the bonding comprises bonding the auxiliary wall, the end portion of the electric wire placed on the bottom portion, and the bottom portion to each other by brazing with resistance welding.

* * * * *